US006799411B2

(12) United States Patent
Gasser et al.

(10) Patent No.: US 6,799,411 B2
(45) Date of Patent: Oct. 5, 2004

(54) APPARATUS AND PROCESS FOR INSERTING INDIVIDUAL PIECE GOODS INTO CONTAINERS

(75) Inventors: Markus Gasser, Gächlingen (CH); Michael Preuss, Hilzingen (DE); Frank-Peter Kirgis, Neuhausen am Rheinfall (CH)

(73) Assignee: SIG Pack Systems, AG (CH)

( * ) Notice: Subject to any disclaimer, the term of this patent is extended or adjusted under 35 U.S.C. 154(b) by 32 days.

(21) Appl. No.: 10/354,850

(22) Filed: Jan. 30, 2003

(65) Prior Publication Data

US 2003/0150193 A1 Aug. 14, 2003

(30) Foreign Application Priority Data

Feb. 13, 2002 (CH) ..... 2002 0244/02

(51) Int. Cl.[7] ..... B65B 5/12

(52) U.S. Cl. ..... 53/251; 53/473; 198/347.4; 414/789.9; 414/793

(58) Field of Search ..... 414/404, 416.05, 414/788.4, 789.9, 790.4, 793; 53/55, 250, 251, 473; 198/347.4, 347.3, 468.4

(56) References Cited

U.S. PATENT DOCUMENTS 4,907,398 A * 3/1990 Holze et al. ..... 53/443
4,982,553 A * 1/1991 Itoh ..... 53/246
5,256,029 A * 10/1993 Fluck ..... 414/792.9
5,350,050 A * 9/1994 Franke ..... 198/347.1
5,426,921 A * 6/1995 Beckmann ..... 53/566
5,477,663 A * 12/1995 Smith et al. ..... 53/475
5,501,064 A * 3/1996 Ingram et al. ..... 53/473
5,553,442 A * 9/1996 Fadaie ..... 53/445
5,636,722 A * 6/1997 Koop ..... 198/347.1
5,771,657 A * 6/1998 Lasher et al. ..... 53/55
5,921,375 A * 7/1999 van Laar ..... 198/471.1
6,105,338 A * 8/2000 Kalany et al. ..... 53/252
6,438,928 B1 * 8/2002 Huang et al. ..... 53/473

FOREIGN PATENT DOCUMENTS

| | | |
|---|---|---|
| EP | 1 078 855 | 8/2000 |
| EP | 1 160 166 | 5/2001 |
| WO | WO 01/02250 | 1/2001 |

* cited by examiner

*Primary Examiner*—Douglas Hess
(74) *Attorney, Agent, or Firm*—Harness, Dickey & Pierce, P.L.C.

(57) ABSTRACT

An apparatus for inserting individual piece goods (3) into containers (4) has a first conveyor (1) for feeding the individual piece goods (3), and a second conveyor (2) for feeding the containers (4), and at least one picker unit (5). At least one of the at least one picker units (5) inserts a number x of piece goods (3) from the first conveyor (1) into a container (4), the container (4) holding a number N>x of piece goods (3). The apparatus also has at least one separate transfer unit (U) for transferring the final N−x piece goods (3) into the container (4) holding N piece goods (3), at least one of the at least one picker units (5) transferring the N−x piece goods (3) from the first conveyor (1) into the transfer unit (U).

12 Claims, 5 Drawing Sheets

APPARATUS AND PROCESS FOR INSERTING INDIVIDUAL PIECE GOODS INTO CONTAINERS

TECHNICAL FIELD

The invention relates to an apparatus and to a process for inserting individual piece goods into containers.

BACKGROUND OF THE INVENTION

EP-A-1,078,855 discloses an apparatus by means of which groups of products, in particular cookies, can be inserted extremely reliably into packaging containers. The apparatus has end-side supporting means which may be adapted in accordance with the length of the group. The apparatus also has first retaining bars, which bear the group of products before the latter, guided by means of second retaining bars, are moved downward and pushed into the container.

Furthermore, WO 01/02250 discloses a packaging apparatus in the case of which the piece goods are brought individually on a conveying belt to an introduction station, where they are introduced in stack form into vertically upright containers. For this purpose, the container is moved downward by the height of one piece-goods article, with the result that the next piece-goods article can drop into the container from the conveyor.

Furthermore, EP-A-1,160,166 discloses an apparatus which is intended for inserting individual piece goods into a container and in the case of which the piece goods are positioned individually into the containers from a conveyor. For this purpose, use is made of picker units, preferably delta robots, which are provided with gripping means. This method of filling the containers gives rise to the problem of it being difficult for the container to be filled completely because the gripping means would take up too much space during the introduction operation. This problem is solved in the prior art by the containers having a specific shape which allows a maximum degree of filling. For example, the containers have an end convexity into which the gripping means can project. However, adaptation of the container shape is not desirable since the shape of the packaging should be as flexible as possible in order to be able to satisfy all marketing and market requirements. In addition, product tolerances and container movements prevent the containers, even those with the adapted shapes, from being filled completely. Furthermore, the piece goods which have already been introduced are often compressed to some extent by the robot, or the other introduction apparatuses, in order to provide sufficient space for the introduction of the final piece goods. If the control means are incorrectly adjusted, however, this results in piece goods which are already located in the container being damaged.

SUMMARY OF THE INVENTION

It is an object of the invention to provide an apparatus and a process for inserting individual piece goods into containers which allow the container to be filled completely irrespective of the container shape.

This object is achieved by an apparatus and a process having the features of patent claims 1 and 12, respectively.

The apparatus according to the invention has a first conveyor for feeding individual piece goods and a second conveyor for feeding the containers. At least one picker unit inserts x piece goods individually into a container which could accommodate a total of N piece goods, where N is greater than x. For the purpose of filling the container with the final N−x piece goods, the invention provides a separate transfer unit, which obtains the corresponding number of piece goods from at least one picker unit and transfers the piece goods into the containers.

It is thus possible to use the quick and flexibly programmable picker units, in particular delta robots, to fill the container virtually completely. The special transfer unit is provided for the final piece goods for each container, said transfer unit pushing these piece goods into the containers, or allowing them to drop therein, and thus not having to reach into the containers itself.

The transfer unit according to the invention has an intermediate storage unit or an intermediate conveying unit, to which the at least one picker unit transfers the piece goods. A pushing means is preferably also provided, this interacting with the intermediate storage or intermediate conveying unit and introducing the piece goods into the constricted amount of space still remaining in the container.

In one embodiment, the intermediate conveying unit moves at least more or less synchronously with the second conveyor which transports the already virtually completely filled containers.

In another embodiment, both the push-in means and the intermediate storage unit are of stationary design.

The apparatus according to the invention allows containers of any desired shape, in particular rectangular containers, to be filled completely. Product tolerances and container movements no longer adversely affect the filling operation. In addition, there is no need for any pressing-down action when the final piece goods are inserted.

Further advantageous embodiments can be gathered from the dependent patent claims.

BRIEF DESCRIPTION OF THE DRAWINGS

The subject matter of the invention is explained hereinbelow with reference to preferred exemplary embodiments which are illustrated in the attached drawings, in which.

PREFERRED EMBODIMENTS OF THE INVENTION

Figure 1:
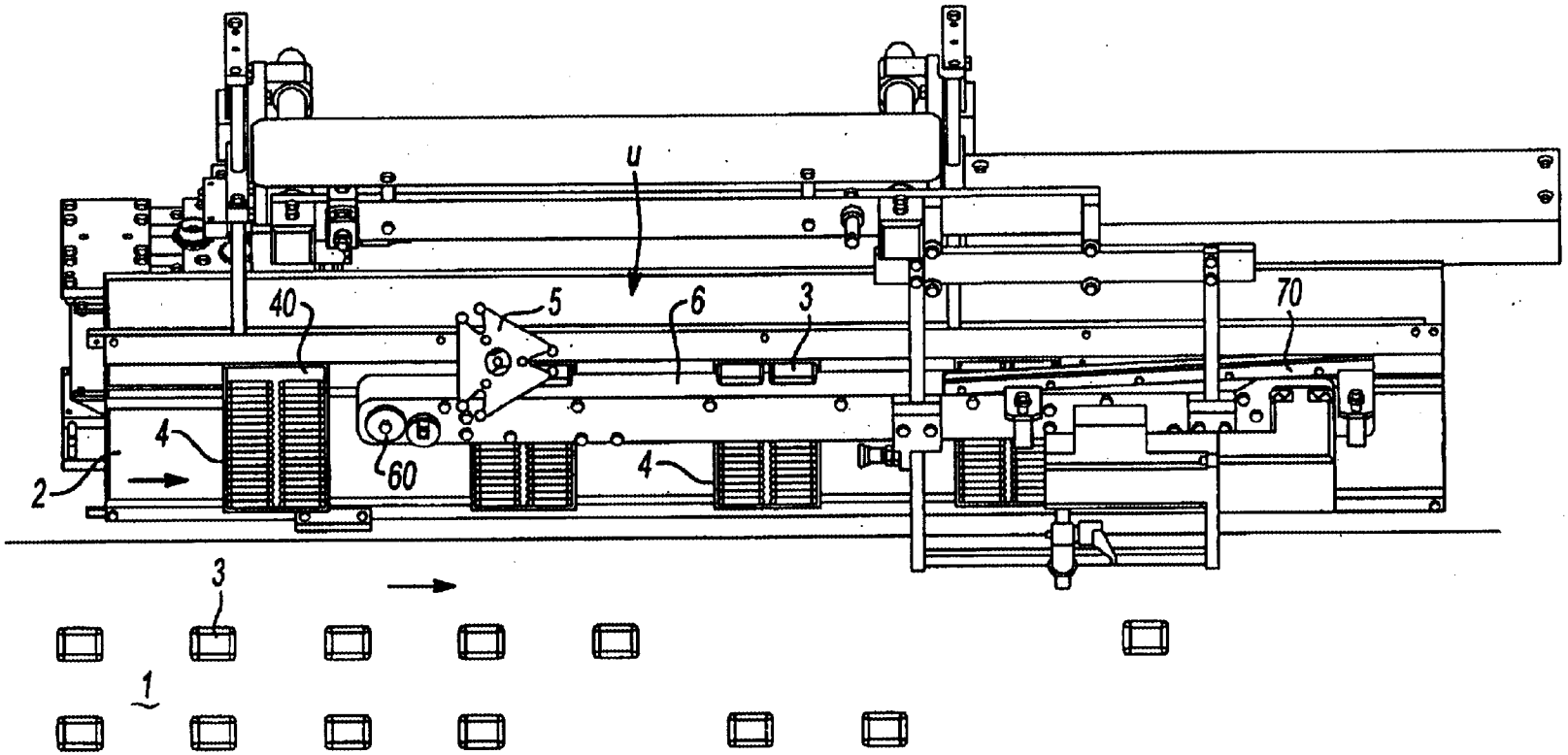
FIG. 1 shows a schematic view of a first embodiment of an apparatus according to the invention from above.

FIG. 1 illustrates a first embodiment of the apparatus according to the invention. It has a first conveyor 1, for example a circulating conveying belt, of which the top strand runs horizontally. On this first conveyor 1, individual piece goods 3 are conveyed in an ordered or random formation to a packaging station. Provided in said packaging station is a second conveyor 2, which may likewise be a circulating conveying belt. On said second conveyor 2, containers 4 are transported up in the empty state and transported away in the filled state. The two conveyors 1, 2 preferably have parallel conveying directions. Containers 4 and piece goods 3, as is illustrated by arrows in FIG. 1, may run in the same direction. However, it is also possible for them to be transported in different directions, in particular in counterflow. The containers 4 are preferably inclined in relation to the horizontal plane and toward the first conveyor 1 in order to make it easier for the piece goods 3 to be introduced.

The piece goods 3 are picked up in a known manner from the first conveyor 1 by means of picker units using gripping means, in particular by means of so-called delta robots, and positioned in the containers 4. It is customary for a plurality of picker units to be arranged one behind the other in the conveying direction. These picker units fill up the containers 4 as far as possible, a still unfilled space 40 remaining in the top region of the containers 4, said region being directed away from the first conveyor. In other words, containers which can actually hold N piece goods are only filled with a number x of piece goods, where x<N. Containers 3 which are virtually completely filled in this way are then brought into the region of the transfer unit U according to the invention by means of the second conveyor 2.

This transfer unit U has an intermediate storage unit or an intermediate conveying unit and preferably a push-in means. Also arranged in the region of said transfer unit is a final picker unit 5, for example a delta robot with a suction cup. Said picker unit 5 may be used exclusively for inserting the final piece goods 3. It is also possible, however, for it also to be used, at least in part, for filling the containers 4 with the x piece goods 3.

In the example illustrated here, an intermediate unit designed as an abutment belt 6 is provided. The abutment belt 6 is guided around two deflecting rollers 60. It has at least one section extending in the conveying direction of the second conveyor 2. It has an abutment surface 61 which is oriented at an angle, for example of 90°, in relation to the second conveyor 2. The angle advantageously corresponds at least more or less to the angle of the piece-goods article 3 in its end position in the container 4. In a preferred embodiment, the abutment belt 6 can be moved around the deflecting rollers, in which case it moves at least more or less synchronously with the second conveyor 2. It is also possible, however, for it to be of a stationary design.

Figure 2:
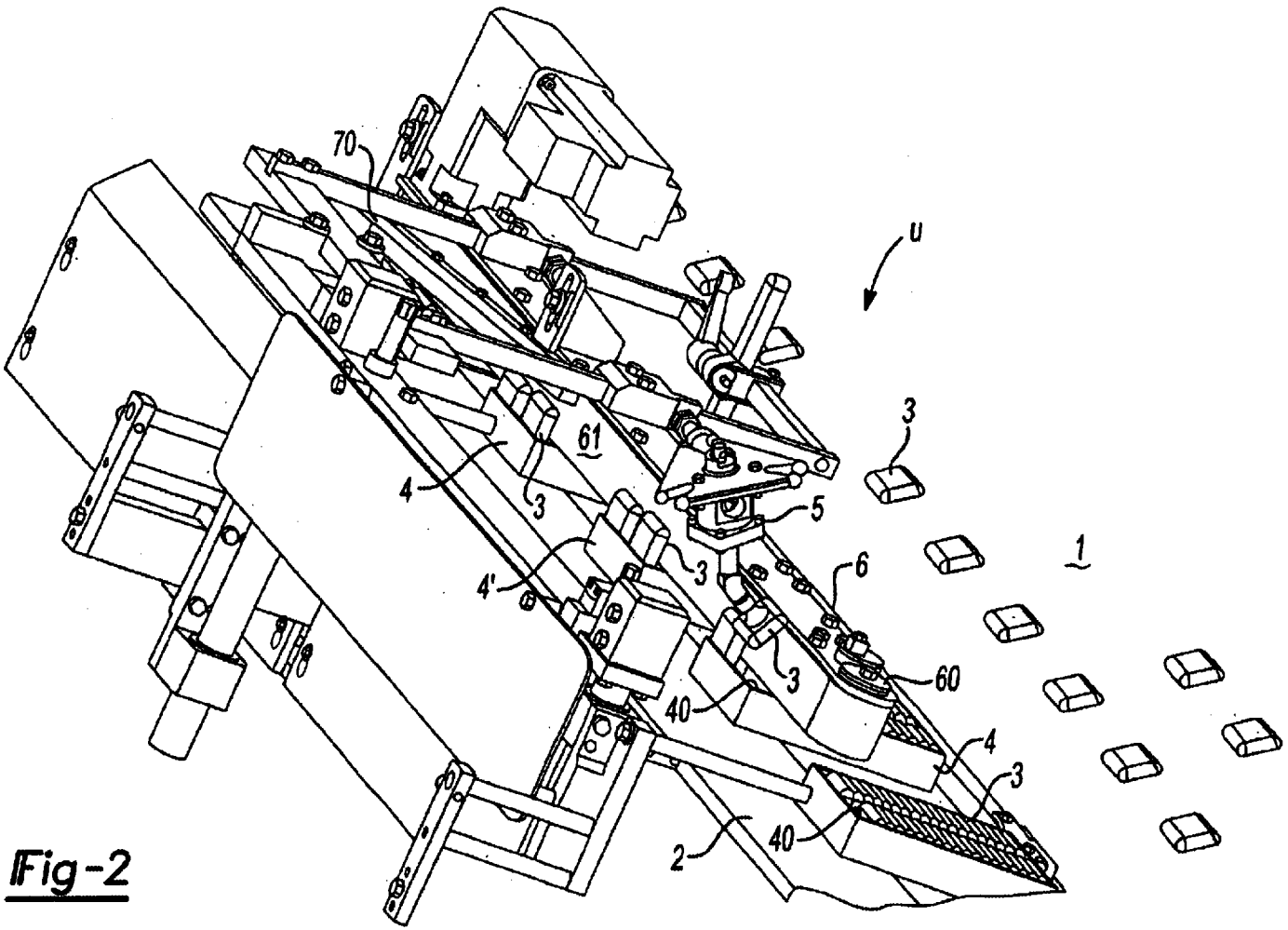
FIG. 2 shows a perspective view of the apparatus according to FIG. 1 in a first operating position.
Figure 3:
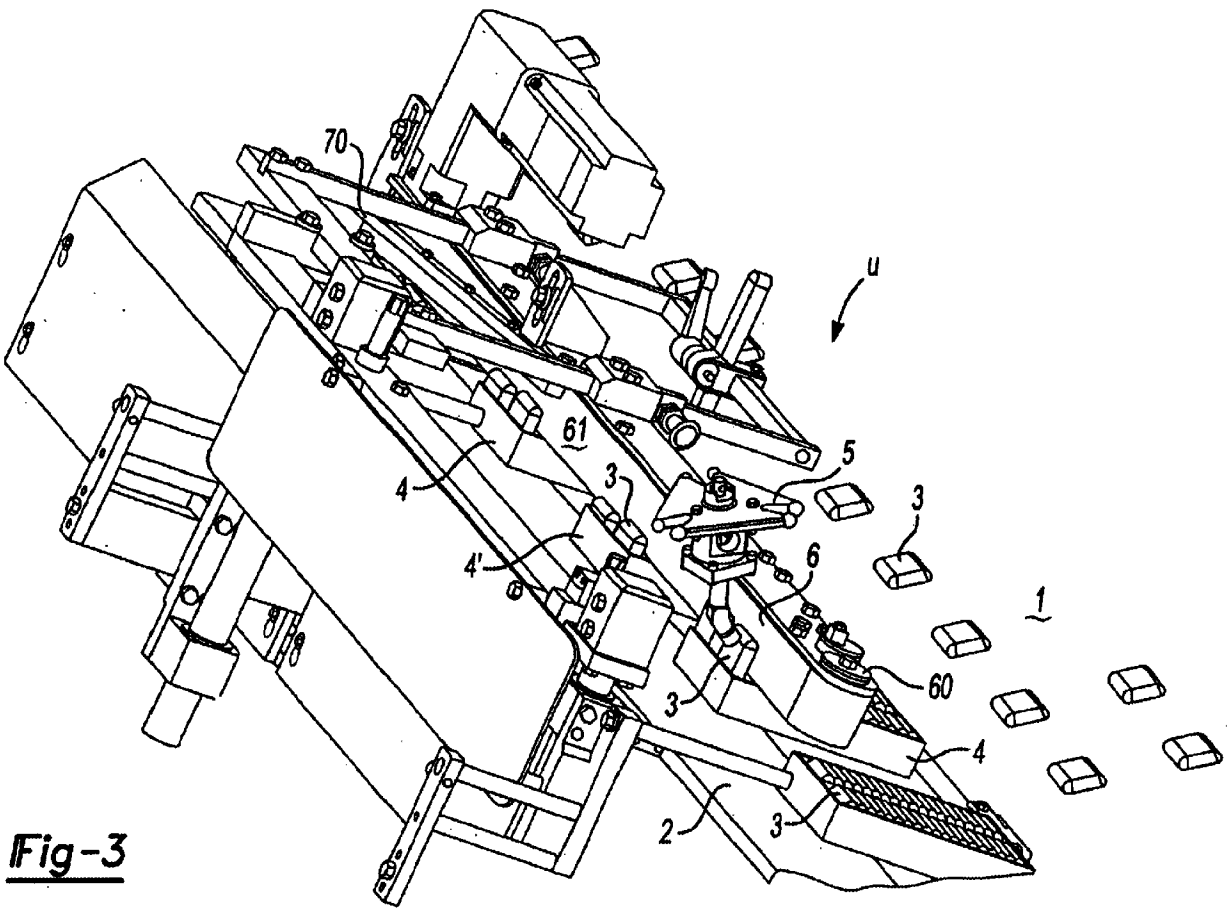
FIG. 3 shows a perspective view of the apparatus according to FIG. 1 in a second operating position.

As is illustrated in FIG. 2, the at least one final picker unit 5 collects a piece-goods article 3 from the first conveyor and positions it against the abutment surface 61 of the abutment belt 6, as is illustrated in FIG. 3. As a result of the gravitational force and by virtue of the suitable nature of the surface area of the abutment surface 61, the piece-goods article slides part of the way into the empty space 40 of the container. It is also possible, however, for it to be pushed part of the way downward into the container 4 by means of the picker unit. Depending on the type of piece-goods article 3 and the nature of the surface area of the abutment surface 61, it is then possible for it to slide all the way into the container 4 of its own accord, as can be seen in the case of the container 4' downstream of the picker unit 5.

The preferred embodiments, however, provide a push-in means, which is arranged downstream. In this example, this means is a push-in bar 70 which is arranged above the second conveyor 2, at an acute angle to the latter, in which case it is inclined toward the second conveyor 2, and thus toward the containers 4, in the conveying direction. The piece goods 3 which are the last to be introduced are conveyed in the direction of the pushing bar 70 by the container 4 or, in the case of the abutment belt 6 rotating, by the latter together with the container 4. At the pushing bar, they are pushed all the way into the container 4, which may then be delivered for final packaging. It is thus possible for this at least one final picker unit to introduce the still missing N−x piece goods 3 into the container 4 without any adverse effects. This embodiment has the advantage that the transfer unit U comprises a relatively small number of parts with the result that it does not render the installation as a whole more expensive. In addition, it can be used for any desired shapes of piece goods and, in the case of the piece goods being changed over, need not be adapted correspondingly. It is not absolutely necessary for the second conveyor 2 and the transfer unit to be synchronized, which also facilitates the control.

Figure 4:
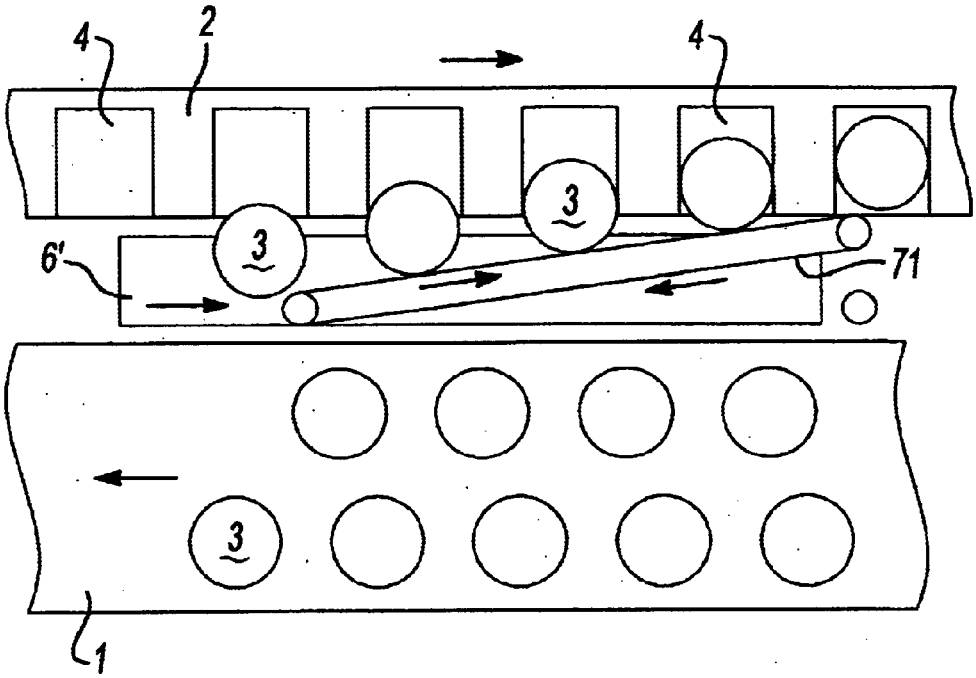
FIG. 4 shows a schematic view of a second embodiment of an apparatus according to the invention from above.

FIG. 4 illustrates a second exemplary embodiment of the apparatus according to the invention. Here too a first conveyor 1 is provided for feeding the individual piece goods 3 and a second conveyor 2 is provided for feeding the containers 4. In this case, the piece goods 3 and the containers 4 are transported up in counterflow, although other directions are also possible. The containers, once again, are preferably transported at an angle to the horizontal plane in which the piece goods are conveyed. The transfer unit according to the invention, in this embodiment, has a third conveyor 6' which is arranged between the first and second conveyors, in the top region of the containers 4. It preferably moves synchronously with and, at least in certain sections, in the same conveying direction as the second conveyor 2, or the containers 4 transported thereon, and, in turn, is at an angle which corresponds to the desired end position of the piece-goods article 3 in the container 4. The third conveyor 6' is preferably a circulating belt conveyor. The final picker unit, which is not illustrated here, then positions the final N−x piece goods 3 on the third conveyor 6'. They are preferably positioned on the third conveyor 6' with a space in between them which corresponds to the spacing between the containers 4. If more than one final piece-goods article 3 is to be introduced into a container 4, then the transporting speeds of the second and third conveyors 2, 6' are synchronized correspondingly and/or the spacing between the piece goods positioned on the third conveyor 6' is adapted correspondingly. It is also possible, however, for the third conveyor 6' to be designed as a dead surface, with the result that the piece goods 3 merely slide on the surface and, since they have already been pushed part of the way into the containers by the picker unit and/or have already slid part of the way into the containers as a result of gravitational force, they are carried along by the containers 4.

Figure 5:
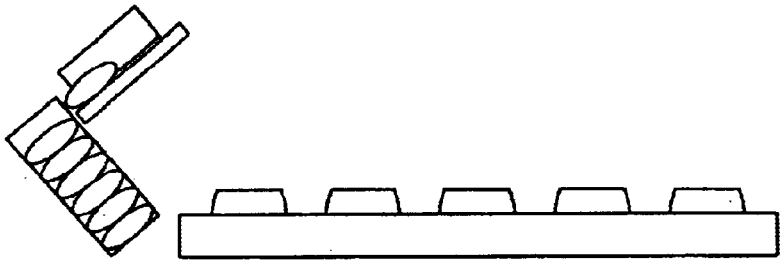
FIG. 5 shows a lateral view of the apparatus according to FIG. 4.

The piece goods 3 positioned on the third conveyor 6', once again, are pushed into the empty space of the container 4 by a push-in means. The push-in means is inclined at an acute angle toward the second conveyor in the transporting direction and is oriented at an angle, preferably 90°, to the transporting surface of the third conveyor 6'. The push-in means may, once again, be a push-in bar. In the example illustrated here, the push-in means, however, is a fourth conveyor 71, which is preferably likewise a circulating belt conveyor and is moved synchronously with the third conveyor 6'. As can be seen in FIG. 5, the fourth conveyor 71 introduces the piece goods 3 into the empty space at the top of the container 4 by way of its abutment surface, which is oriented at an angle to the bearing surface of the third conveyor.

Figure 6:
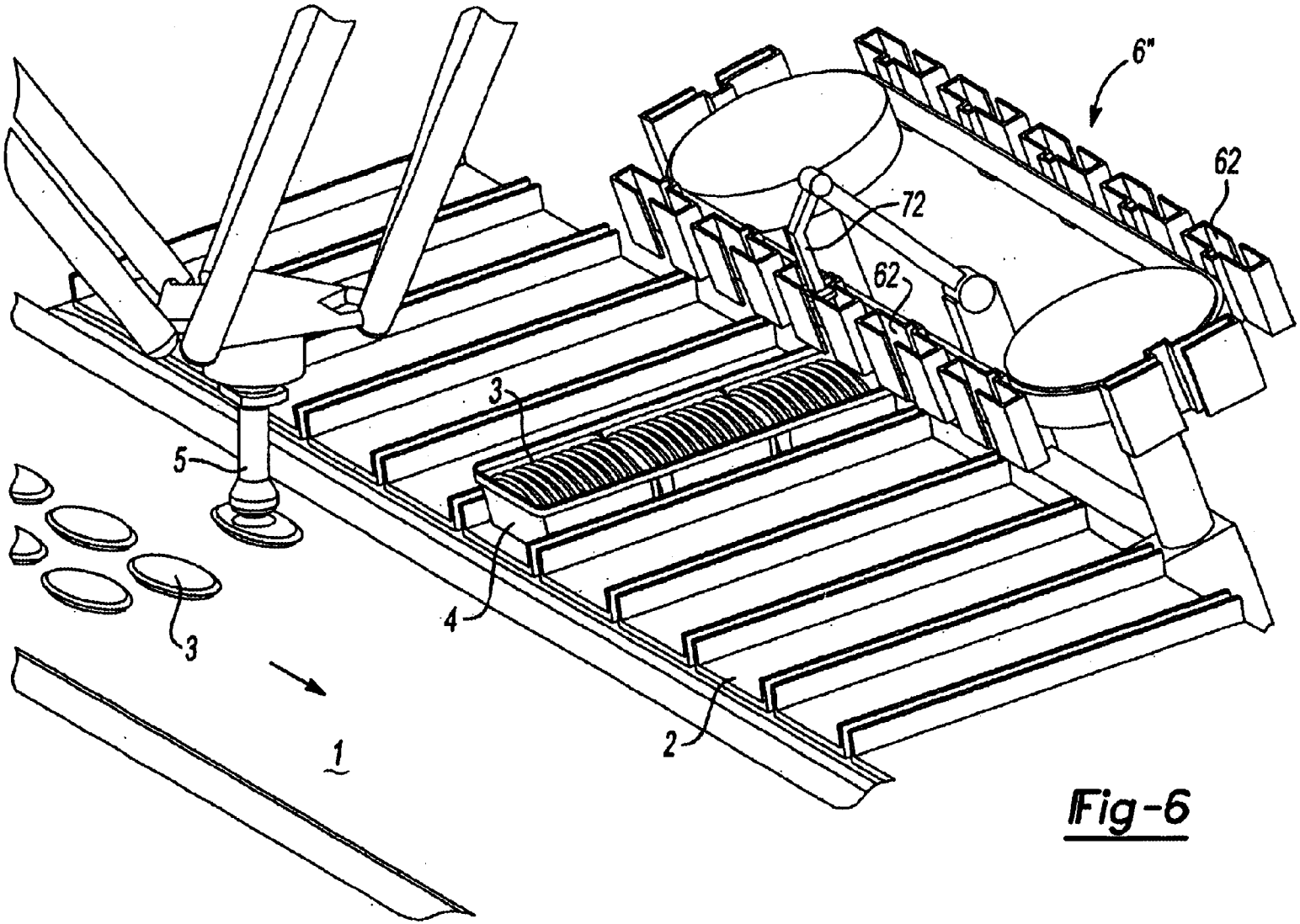
FIG. 6 shows a perspective view of a third embodiment of an apparatus according to the invention.

FIG. 6 illustrates a third exemplary embodiment. Here too, the containers 4 and the individual piece goods 3 are respectively transported on a first conveyor 1 and a second conveyor 2, the containers 4 preferably being inclined in relation to the at least more or less horizontal transporting surface of the piece goods 3. The transfer unit U here has a pocket conveyor 6" which extends, at least in certain sections, in the conveying direction of the second conveyor 2 and, in turn, is preferably moved synchronously therewith. It is also possible, however, for it to be stationary. The pocket conveyor 6' has pockets 62 which are open at the top and, at the bottom, preferably have a base which can be opened. The pockets are oriented perpendicularly to the container 4 or are arranged at that angle at which the piece goods 3 are arranged in the containers 4. The shape of the pockets 62 is preferably adapted to the piece-goods article 3, it preferably being possible for said pockets to accommodate precisely one piece-goods article 3. The at least one final picker unit 5 collects the final N−x piece goods 2 from the first conveyor and positions them in the pockets 62 of the pocket conveyor 6" from above. If a filled pocket is located above a container 4 which is still not filled completely, then the base is opened and the piece-goods article 3 slides into the empty space 40 of the container 4. A push-in means is preferably provided for this purpose. In this example, this means is a push rod 72, which extends into, the corresponding pocket 62 from above and by means of which the piece-goods article 3 located therein is pushed downward into the container 4. This embodiment has the advantage that the piece goods 3 can be treated without any adverse effects since the pockets 62 protect them. It is also possible for the piece goods 3 to be deposited in all desired directions in the containers 4. It is possible for the containers to be filled with assorted, different piece goods.

These apparatuses according to the invention can be used for all types of piece goods. Their preferred application area, however, is the foodstuffs industry, in particular the packaging of disk-like products such as cookies or potato chips. The apparatus according to the invention allows containers of any desired shape to be filled efficiently and nevertheless completely.

The disclosure of Swiss application No. 2002 0244/02 filed Feb. 13, 2002 is hereby incorporated by reference.

What is claimed is:

1. An apparatus for inserting individual piece goods into containers, the apparatus comprising a first conveyor for feeding the individual piece goods, a second conveyor for feeding the containers, and at least one picker unit, at least one of the at least one picker units inserting a number x of piece goods from the first conveyor into one of said containers, and said container holding a number N>x of piece goods, wherein at least one separate transfer unit is provided for transferring the final N−x piece goods into the container holding N piece goods, at least one of the at least one picker units transferring the N−x piece goods from the first conveyor into the transfer unit.

2. The apparatus as claimed in claim 1, wherein the transfer unit has a push-in means for pushing the N−x piece goods into the container.

3. The apparatus as claimed in claim 1, wherein the second conveyor transports the containers in a plane which is inclined in relation to the conveying plane of the first conveyor.

4. The apparatus as claimed in claim 1, wherein the transfer unit has an abutment belt which extends, at least in certain sections, in the conveying direction of the second conveyor and is intended for the abutment of the N−x piece goods.

5. The apparatus as claimed in claim 4, wherein, in relation to the second conveyor, the abutment belt is arranged at an angle which corresponds at least approximately to an end position of the N−x piece goods in the container.

6. The apparatus as claimed in claims 2 and 4, wherein the push-in means is a push-in bar which is oriented at an angle to the second conveyor.

7. The apparatus as claimed in claim 2, wherein the transfer unit has a third conveyor which, at least in certain sections, runs parallel to the second conveyor and at an angle thereto which corresponds at least approximately to an end position of the N−x piece goods in the container, and wherein the push-in means is oriented at an angle to the third conveyor, it being inclined at an acute angle toward the second conveyor, in the conveying direction of the latter.

8. The apparatus as claimed in claim 7, wherein the push-in means is a fourth conveyor with an abutment surface which is oriented at an angle to the bearing surface of the third conveyor.

9. The apparatus as claimed in claim 1, wherein the transfer unit has a pocket conveyor which extends, at least in certain sections, in the conveying direction of the second conveyor, and wherein the pocket conveyor has pockets for accommodating the N−x piece goods.

10. The apparatus as claimed in claim 9, wherein the pockets have a base which can be opened.

11. The apparatus as claimed in claim 2 and 10, wherein the push-in element is a push-rod which can be pushed into one of the pockets from above in order for a piece-goods article located therein to be pushed downward into the container.

12. A process for inserting individual piece goods into containers, individual piece goods being fed on a first conveyor and containers being fed on a second conveyor, use being made of at least one picker units, and a number x of the piece goods being inserted from the first conveyor into a container by at least one of the at least one picker units, the container holding a number N>x of piece goods, wherein a separate transfer unit introduces the final N−x piece goods into the container holding N piece goods, the N−x piece goods being transferred from the first conveyor into the transfer unit by means of one of the at least one picker units.

* * * * *